US009366027B2

(12) United States Patent
Martigli

(10) Patent No.: US 9,366,027 B2
(45) Date of Patent: Jun. 14, 2016

(54) LATTICE GIRDER STRUCTURE USING INNOVATIVE MULTIPLE JOINTS FOR ROOF COVERING PURPOSES

(71) Applicants: Monica Serafini, Capraia e Limite (IT) Maddalena Martigli, Capraia e Limite (IT) Fabrizio Martigli, Capraia e Limite (IT)

(72) Inventor: Massimo Martigli, Capraia E Limite (IT)

( * ) Notice: Subject to any disclaimer, the term of this patent is extended or adjusted under 35 U.S.C. 154(b) by 0 days.

(21) Appl. No.: 14/370,785

(22) PCT Filed: Jan. 10, 2013

(86) PCT No.: PCT/EP2013/050430

§ 371 (c)(1),
(2) Date: Jul. 7, 2014

(87) PCT Pub. No.: WO2013/104730

PCT Pub. Date: Jul. 18, 2013

(65) Prior Publication Data

US 2014/0373481 A1 Dec. 25, 2014

(30) Foreign Application Priority Data

Jan. 13, 2012 (IT) ..... FI2012A0004

(51) Int. Cl.
*E04B 7/02* (2006.01)
*E04C 3/04* (2006.01)
(Continued)

(52) U.S. Cl.
CPC ..... *E04B 7/022* (2013.01); *E04B 1/1903* (2013.01); *E04B 7/024* (2013.01); *E04C 3/02* (2013.01); *E04C 3/11* (2013.01); *E04C 3/17* (2013.01);
(Continued)

(58) Field of Classification Search
CPC ..... E04C 3/11; E04C 3/17; E04C 2003/0491; E04C 2003/005; E04C 2003/0486; E04C 3/08; E04C 3/02; E04B 1/25; E04B 2001/2415; E04B 7/022; E04B 1/19; E04B 1/1903; E04B 1/1918; E04B 1/1963; E04B 1/1966
USPC ..... 52/633, 634, 637, 639, 643, 648.1, 52/650.1, 650.2, 652.1, 653.1, 655.1, 660
See application file for complete search history.

(56) References Cited

U.S. PATENT DOCUMENTS 3,668,828 A * 6/1972 Nicholas et al. ..... 52/92.1
3,701,225 A * 10/1972 Perry ..... 52/71
(Continued)

FOREIGN PATENT DOCUMENTS

DE 202008014900 U1 2/2009
EP 1293619 A1 3/2003
FR 910705 A 6/1946

OTHER PUBLICATIONS

International Search Report issued in corresponding International Patent Application No. PCT/EP2013/050430 dated Mar. 25, 2013 (11 pages).
(Continued)

*Primary Examiner* — Joshua J Michener
*Assistant Examiner* — Kyle Walraed-Sullivan
(74) *Attorney, Agent, or Firm* — Kilyk & Bowersox, P.L.L.C.

(57) ABSTRACT

Roof truss system comprising tie rods, struts, knee rafters, and innovative connection joints to cover buildings, especially suitable for being implemented by plastic materials.

7 Claims, 5 Drawing Sheets

(51) Int. Cl.

| | |
|---|---|
| ***E04C 3/11*** | (2006.01) |
| ***E04C 3/17*** | (2006.01) |
| ***E04B 1/19*** | (2006.01) |
| ***E04C 3/02*** | (2006.01) |

(52) U.S. Cl.
CPC ... *E04B 2001/199* (2013.01); *E04B 2001/1924* (2013.01); *E04C 2003/0491* (2013.01)

(56) References Cited

U.S. PATENT DOCUMENTS

| | | | | | |
|---|---|---|---|---|---|
| 3,785,108 | A | * | 1/1974 | Satchell | 52/645 |
| 4,187,652 | A | * | 2/1980 | Bobrovnikov et al. | 52/90.1 |
| 5,542,227 | A | * | 8/1996 | Frayne | 52/639 |
| 5,722,210 | A | * | 3/1998 | Baker et al. | 52/643 |
| 5,819,492 | A | * | 10/1998 | Konicek | 52/641 |
| 5,890,339 | A | * | 4/1999 | Willis | 52/640 |
| 5,901,522 | A | * | 5/1999 | Slater | 52/641 |
| 5,983,577 | A | * | 11/1999 | Hays | 52/79.1 |
| 6,430,887 | B1 | * | 8/2002 | Daudet | 52/641 |
| 6,634,152 | B1 | * | 10/2003 | Pilkinton | 52/641 |
| 6,758,022 | B1 | * | 7/2004 | Coll et al. | 52/690 |
| 7,131,243 | B1 | * | 11/2006 | Sirowatka | 52/604 |
| 2006/0123733 | A1 | | 6/2006 | Moody et al. | |
| 2007/0107365 | A1 | | 5/2007 | Kennelly et al. | |
| 2008/0184651 | A1 | | 8/2008 | Bowman | |
| 2010/0031586 | A1 | * | 2/2010 | Miller | 52/93.1 |
| 2010/0192506 | A1 | * | 8/2010 | Allred et al. | 52/655.1 |
| 2010/0310325 | A1 | | 12/2010 | Stankus et al. | |
| 2010/0326003 | A1 | * | 12/2010 | Davies | 52/641 |

OTHER PUBLICATIONS

Office Action issued in corresponding Cuban Patent Application No. 2014-0084 dated Apr. 7, 2015 (2 pages).

Office Action issued in corresponding Panamanian Patent Application No. 90270-01 dated Jun. 9, 2015 (3 pages).

* cited by examiner

LATTICE GIRDER STRUCTURE USING INNOVATIVE MULTIPLE JOINTS FOR ROOF COVERING PURPOSES

This application is a National Stage Application of PCT/EP2013/050430, filed Jan. 10, 2013, which claims priority to Italian Patent Application No. FI2012A000004, filed Jan. 13, 2012.

TECHNICAL FIELD

This invention relates to a roof truss system suitable for supporting the roofs of buildings.

Specifically, this system comprises longitudinal elements and special joints, besides all elements necessary to build roof trusses of a lattice girder type and to interconnect different roof trusses to each other and to support the covering surface.

PRIOR ART

In the building field, it is a common practice to discriminate and classify the different types of roofs known on the basis of the morphology of the covering surface or on the basis of the slope of such a covering surface.

Morphologically wise, roofs are classified into continuous and discontinuous roofs: in the former, the surface covering is usually formed of elements featuring very wide surfaces, joined to each other upon laying them out to form an uninterrupted layer, suitable for roofs of any slopes; in the latter, on the contrary, the covering surface is discontinuous, being formed of several separate elements, capable of ensuring watertightness thanks to their interconnections and slope.

As already said, a further possible classification is based on the roof's slope.

In this case, we speak about plane roofs, featuring minor slopes (usually less than 5%), however sufficient to drain the rainwater, and pitched roofs, featuring one or several tilted plane faces called pitches.

Pitched roofs can in turn be classified into a number of sub-categories as a function of their bearing structure or roof scaffolding.

The invention described in this patent application finds its main application in the field of the tilted pitch structures featuring a roof truss-based bearing structure.

A roof of this type comprises a set of basic architectural elements, namely the mentioned roof trusses, which are arranged in series and usually lean on two opposed walls; then, the secondary structure of the roof, that on which the covering surface will lean, is laid on the primary bearing structure consisting of the trusses.

A roof truss is a plane lattice girder system arranged vertically, featuring such a triangular structure as not to transmit horizontal thrusts to the bearing walls of the building on which it leans.

A roof truss basically consists of:

- an horizontal element (tie rod), which makes up the base of the triangle;
- two tilted elements (struts or principal rafters), which make up the remaining two sides of the triangle and determine the roof's slope;
- a vertical element (king post) extending from the apex to the base of the triangle.

The type of truss described above is usually referred to as "king truss" and is generally used to cover spans up to 6 to 7 meters wide.

The secondary structure of the roof consists of a set of longitudinal elements arranged perpendicularly to the trusses and leaning on the struts, called purlins; specifically, the longitudinal element leaning on the top of the truss is called ridge pole; the roof scaffolding is completed by further longitudinal elements, featuring smaller dimensions, called rafters, which lean on the ridge pole or purlins, orthogonally thereto, hence parallel to the struts.

Finally, a number of stringers lean on the rafters, parallel to the ridge pole and purlins to support the covering surface.

In the case of wooden roof trusses, the lower section of the king post might even not be directly connected to the tie rod, but rather be fixed to an iron stirrup, the latter passing round the tie rod, whose function is first of all to prevent the king post from moving outside the vertical plane of the truss and secondly to support the tie rod.

In the case of spans 8 to 15 meters wide, other types of trusses are used, for instance trusses formed of two struts, one king post and one tie rod, arranged as with the king trusses, with the addition of two further tilted elements (knee rafters), featuring a slope opposite to the struts one, interposed between the king post and the struts. The knee rafters are basically used to reduce the free deflection length of the struts.

Structures of bigger dimensions or engineered to support heavier loads might also be equipped with a number of intermediate rafters, also called knee rafters, arranged between each of the two struts and the tie road, which are basically submitted to traction or compression axial loads.

There are a large variety of types of roof trusses, differing from each other in dimensions, in geometry, and in the type of material used to build them; for instance, in addition to the traditional wood, metals and reinforced concrete are currently also used to build trusses.

In particular, there are many systems to interconnect the individual elements that make up a truss; very often the interconnection systems depend on the type of material used.

In wooden trusses, notches reinforced by nailed iron strirrups are used to interconnect the individual elements that make up the structure.

In the case of metal buildings, the elements that make up the truss are interconnected using nailed, bolted and/or welded metal plates or even directly welded together.

The further elements making up the roof scaffolding, including the ridge pole, the purlins, the stringers, and the rafters, are fixed to the trusses in a similar way.

A truss is either assembled directly in the building yard, starting from the basic elements that make it up, or by using pre-fabricated structures, so as to minimize the assembling times.

Pre-fabricated trusses, especially if their number is consistent or they feature big sizes and hence are heavy, entail substantial difficulties for transportation from their manufacturing place to their erection sites.

To obviate such a drawback, trusses are known for many years that are formed of two or several sections, pre-fabricated in a factory, which are subsequently assembled together in the building yard to form a complete truss. Examples thereof are described in US 2006/0123733 A1 and in WO 2008/097682 A1.

However, this solution too presents a number of disadvantages: as a matter of fact, even though they are pre-fabricated structures, assembling operations are still necessary in the building yard. Moreover, in order to be sure that the loads are transferred correctly and the structural stability is retained, appropriate frameworks and wind bracings are necessary.

In the implementation of trusses complete with knee rafters, the problem arises of connecting such knee rafters to the tie rods or to the struts, while zeroing or at least minimizing the bending moment that is transmitted to the tie rod and to the strut by the joint that the knee rafters are anchored to. Different types of special joints have been developed, including that described in US 2010/0310325 A1, or interconnections systems, like that described in US 2007/0107365 A1.

The construction theory says that, in order to zero the transmitted bending moment, a joint shall be realized in such a way that the extensions of the axes of the knee rafters cross the section of the tie rod or the strut in correspondence with the neutral axis of the latter.

Therefore, the main object of the present invention, which preferably concerns pre-fabricated trusses, is to provide a structural scaffolding for a roof, comprising pre-fabricated longitudinal elements (horizontal tie road, king post, struts, and knee rafters) and means for their interconnection, that are little expensive to build and easy to install.

Specifically, the present invention combines practical and easy transportation, which is typical of structures using non pre-fabricated trusses, to the lightness of the elements that make up the girder system, the latter being preferably made of a plastic material.

Moreover, the elements of a single truss are interconnected by means of multiple interconnection joints specifically developed for this purpose, which are fixed to said elements by specifically developed locking means, including plugs or self-tapping screws or similar devices; such an interconnection method makes it possible to substantially reduce the assembling times, in that it does not require weldings and/or nailings and/or boltings.

Even more advantageously, said multiple interconnection joints make it possible to zero or at least minimize the bending moment transmitted by the joint to the tie rod or to the strut.

The multiple intermediate joints and the lower central joint (that which joins the king post to the tie rod), being provided with special anchoring hinges, make it possible an easy connection of the knee rafters to the struts and to the tie rod.

The purlins and the ridge pole, which complete the main scaffolding of the roof, are installed by inserting them through appropriate holes present in the multiple joints and in the upper central joint, thus facilitating installation and reducing the assembling times.

A truss of the said type is leant on the walls underneath by using appropriate terminal elements (12) located at both ends of the tie rod. Said terminal elements (12), besides realizing the interconnection between a strut and the tie rod, also allow a simple interfacing to the perimetral walls which the truss is leant on.

OBJECTS AND SUMMARY OF THE INVENTION

The main object of the present invention is therefore to provide a complete and integrated system for the implementation of primary and secondary lattice structures for civil covering surfaces that allows a fast and easy installation and makes it possible to zero or at least minimize the bending moment transmitted to the tie rod or to the struts by the interconnection joints to the knee rafters.

The advantages and the technical characteristics of this invention will be evident from the detailed description of an embodiment, provided by way of non-limiting example, that follows.

BRIEF DESCRIPTION OF THE DRAWINGS

FIG. 6 shows an assembled truss, with the two terminal elements (12) which, besides implementing the connection between a strut and the tie rod, also allow the interfacing to the perimetral walls that the truss leans on.

DETAILED DESCRIPTION OF AN EMBODIMENT OF THE INVENTION

Figure 1:
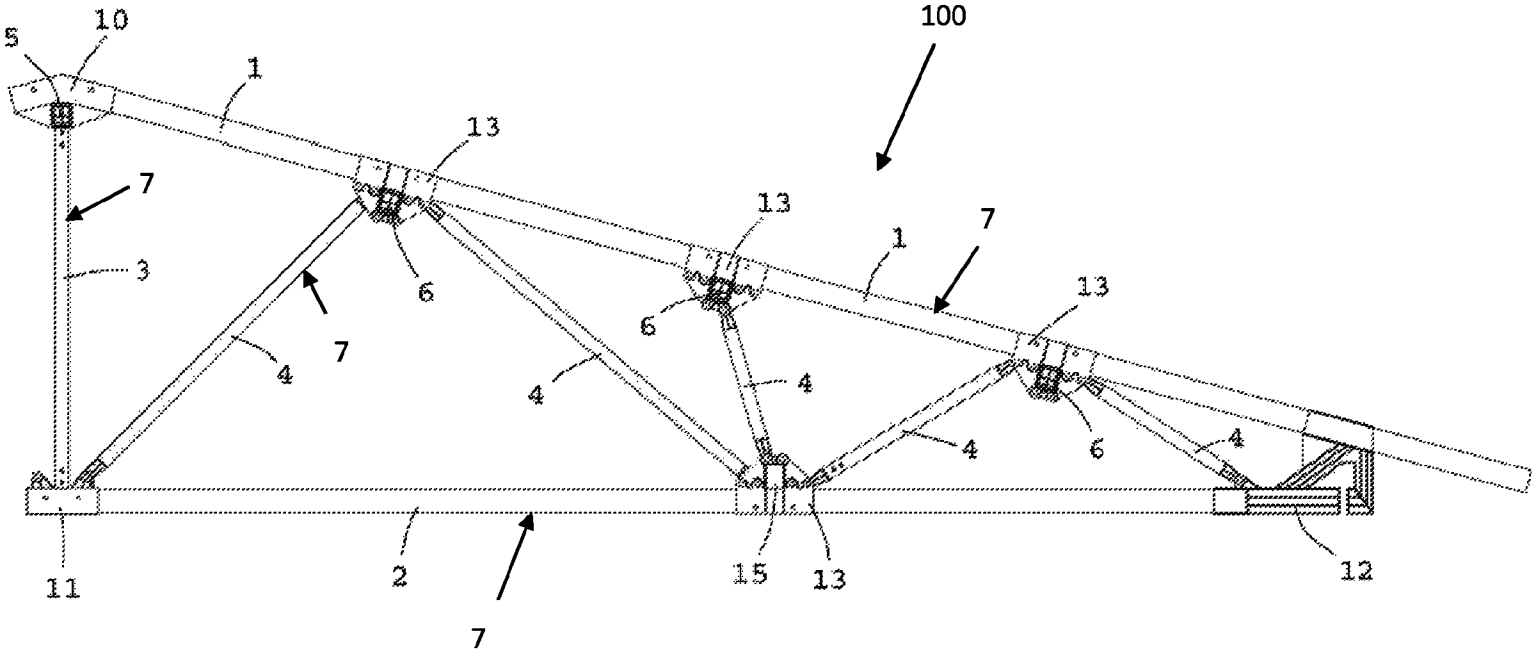
FIG. 1 shows a half-truss (100) comprising primary scaffolding elements (7) which comprise a horizontal tie rod (2), a strut (1), a king post (3) and a number of knee rafters (4). The figure also shows a lower central joint (11), a hip joint (10), a terminal element (12), and four 5 multiple joints (13); the section of a purlin (6) is visible internally to the multiple joint.
Figure 2:
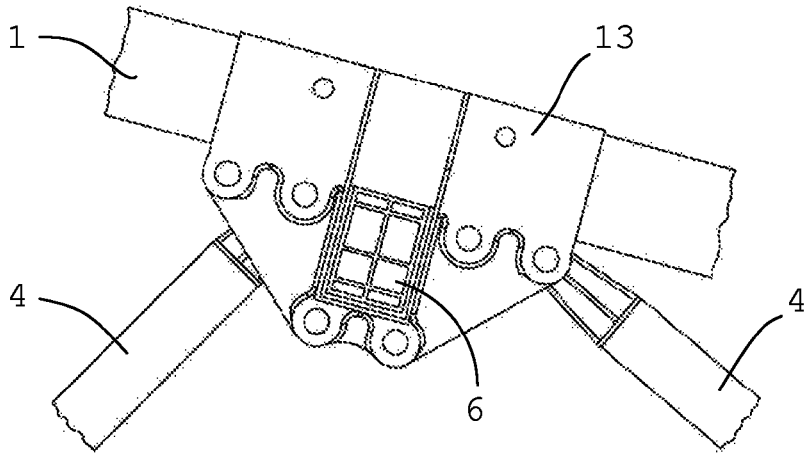
FIG. 2 shows an example of interconnection of a multiple joint (13) to a strut (1) or to a tie rod, with two knee rafters (4), using different connection hinges as a function of the angle formed by the axis of every knee rafter with the axis of the tie rod or the strut.
Figure 3:
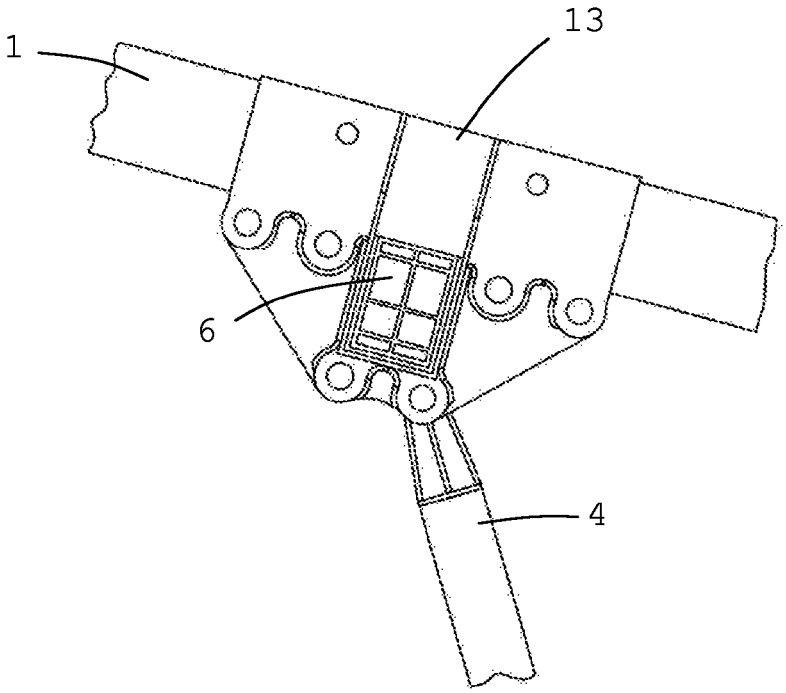
FIG. 3 shows an example of interconnection of a multiple joint (13) to a strut (1) or to a tie rod, with one knee rafter (4), using the connection hinge most appropriate to minimize the bending moment transmitted by the knee rafter (4) to the tie rod or strut (1) via the multiple joint (13); the section of a purlin (6) is visible internally to the multiple joint.
Figure 4:
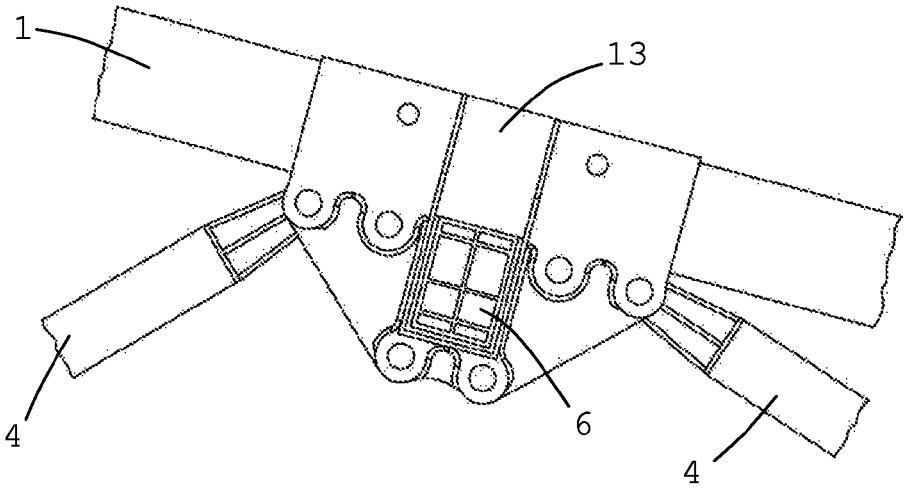
FIG. 4 shows an example of interconnection of a multiple joint (13) to a strut (1), or to a tie rod, with two knee rafters (4), using different connection hinges as a function of the angle formed by the axis of every knee rafter with the axis of the tie rod or the strut; the section of a purlin (6) is visible internally to the multiple joint.
Figure 5:
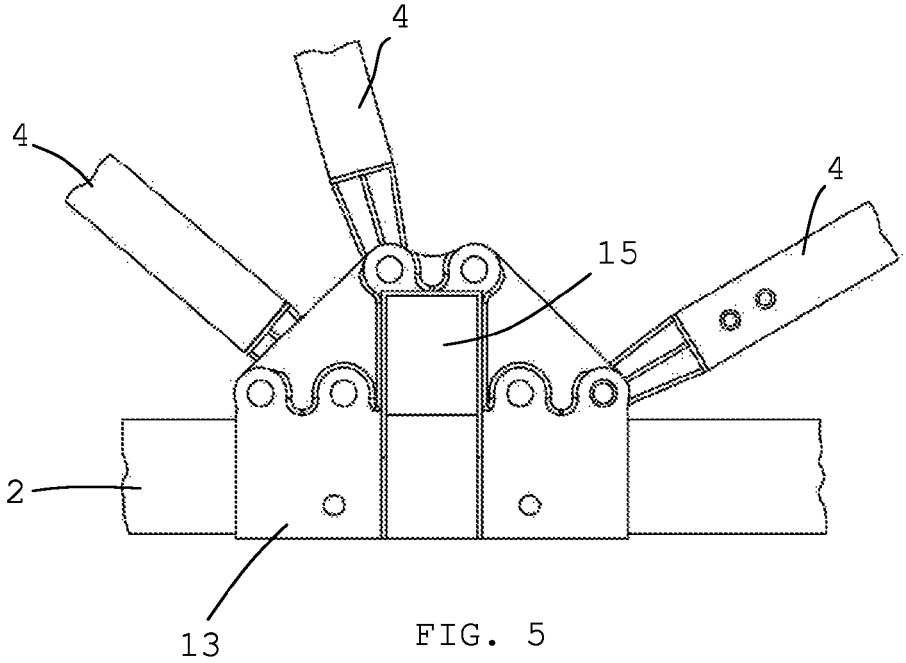
FIG. 5 shows an example of interconnection of a multiple joint (13) to a strut (1), or to a tie rod, with three knee rafters (4), using different connection hinges as a function of the angle formed by the axis of every knee rafter with the axis of the tie rod or strut; the section of a purlin (6) is visible internally to the multiple joint.
Figure 6:
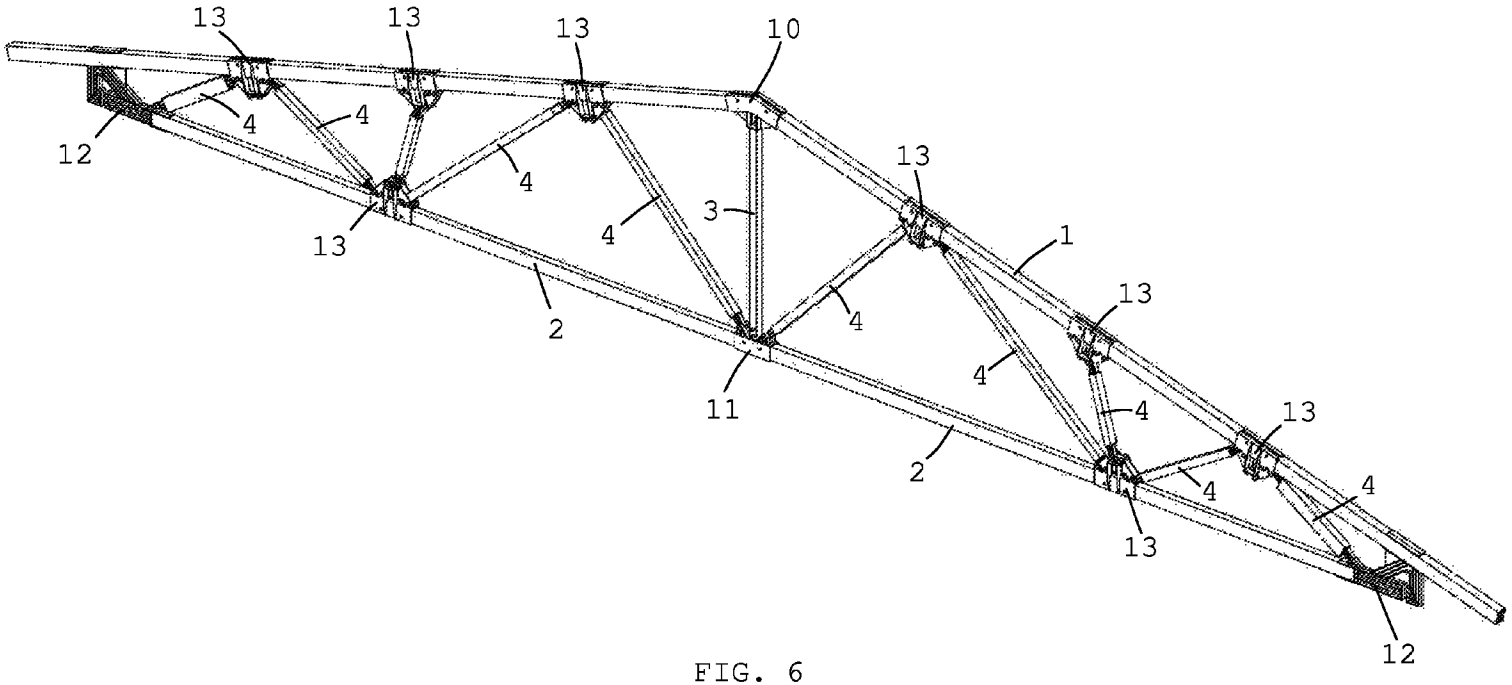
Figure 7:
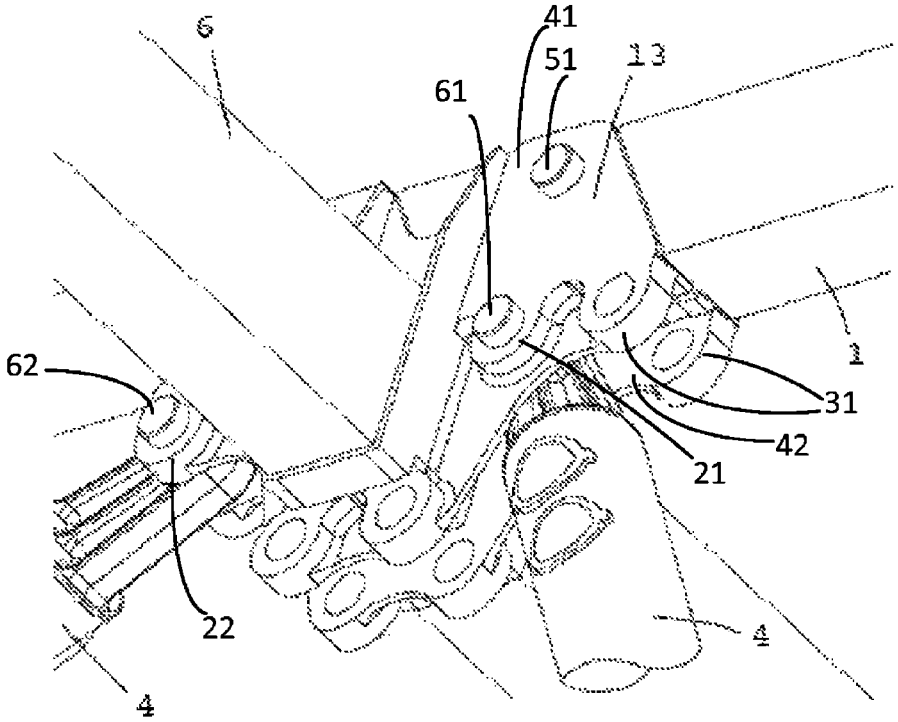
FIG. 7 shows a multiple joint (13) connected to two 5 knee rafters (4), a strut (1), anchoring hinges (21, 22), half-shells (41, 42), through bolt (51), hinge (31), specially designed locking means (61, 62), and a purlin (6).

The present invention consists of an integrated system for the implementation of pre-fabricated trusses, particularly suitable for being realized by elements made of plastic materials.

Specifically, the system comprises multiple joints (13) of an innovative type for connecting the knee rafters (4) to the struts (1) and to the tie rod (2); it also comprises other special joints (10) to connect the struts to the king post; special joints (11) to connect the king post to the tie rod, and special joints (12) to connect the struts to the ends of the tie rod.

The invention claimed is:

1. A lattice girder system (100), comprising primary scaffolding elements (7) comprising struts (1), tie rods (2), king posts (3), and knee rafters (4), and secondary scaffolding elements comprising ridge poles (5), purlins (6), and other rafters, using special joints (10, 11, 12), wherein the special joints (10) connect the struts (1) to a king post (3), the special joints (11) connect the king post (3) to a tie rod (2), and the special joints (12) connect the struts (1) to ends of the tie rod (2), and multiple joints (13) interconnect said primary and secondary scaffolding elements, wherein said knee rafters (4) are constrained to said multiple joints (13) by means of hinges whose axes are perpendicular to a plane of a truss of the lattice girder system, and wherein said multiple joints (13) feature a plurality of anchoring hinges (21, 22) for the knee rafters (4) and are configured for selection of a hinge (31) to connect individual knee rafters as a function of the geometry of the lattice girder system, so as to concentrate an axial thrust transmitted by the individual knee rafters to every tie rod or strut (1) proximate to a neutral axis of the tie rod or strut, wherein said multiple joints (13) feature a recess (15) to permit the passage of structural elements having an axis perpendicular to a plane of a truss of the lattice girder system, wherein the structural elements comprise purlins (6).

2. A lattice girder system according to claim 1, characterized in that said multiple joints (13) are two half-shells (41, 42) joined to each other by connection means.

3. A lattice girder system according to claim 2, characterized in that said connection means are through bolts (51) integral with the half-shells.

4. A lattice girder system according to claim 2, characterized in that said two half-shells are specular to each other.

5. A lattice girder system according to claim 2, characterized in that said two half-shells are identical to each other.

6. A lattice girder system according to claim 1, characterized in that said multiple joints are free of sliding onto the struts (1) or the tie rod (2) up to being locked to the desired position by specially designed locking means (61, 62).

7. A lattice girder system (100), comprising primary scaffolding elements (7) comprising struts (1), tie rods (2), king posts (3), and knee rafters (4), and secondary scaffolding elements comprising ridge poles (5), purlins (6), and other rafters, using special joints (10, 11, 12), wherein the special joints (10) connect the struts (1) to a king post (3), the special joints (11) connect the king post (3) to a tie rod (2), and the special joints (12) connect the struts (1) to ends of the tie rod (2), and multiple joints (13) interconnect said primary and secondary scaffolding elements, wherein said multiple joints (13) feature a recess (15) to permit the passage of structural elements having an axis perpendicular to a plane of a truss of the system of trusses wherein the structural elements comprise purlins (6), and wherein said multiple joints (13) feature a plurality of anchoring hinges (21, 22) for the knee rafters (4) and are configured for selection of a hinge (31) to connect individual knee rafters as a function of the geometry of the lattice girder system, so as to concentrate an axial thrust transmitted by the individual knee rafters to every tie rod or strut (1) proximate to a neutral axis of the tie rod or strut.

* * * * *